United States Patent [19]

Pizzichemi

[11] Patent Number: 4,930,271

[45] Date of Patent: Jun. 5, 1990

[54] ANCHORING MEMBER FOR AN OUTDOOR CONTAINER ESPECIALLY AN OUTDOOR MAILBOX

[76] Inventor: Anthony Pizzichemi, 234 Waverly Ave., Patchoque, N.Y. 11772

[21] Appl. No.: 289,696

[22] Filed: Dec. 27, 1988

[51] Int. Cl.[5] ..... E02D 5/74

[52] U.S. Cl. ..... 52/155

[58] Field of Search ..... 52/155, 162–164

[56] References Cited

U.S. PATENT DOCUMENTS

| | | | |
|---|---|---|---|
| 613,316 | 11/1898 | Robbins | 52/162 |
| 798,945 | 9/1905 | Berntson | 52/154 |
| 1,764,207 | 6/1930 | Johnson | 52/154 |
| 3,512,319 | 5/1970 | Piacentino | 52/162 |
| 4,023,314 | 5/1977 | Tanner | 52/164 |

FOREIGN PATENT DOCUMENTS

| | | | |
|---|---|---|---|
| 586269 | 12/1977 | U.S.S.R. | 52/162 |

*Primary Examiner*—David A. Scherbel
*Assistant Examiner*—Michele A. VanPatten
*Attorney, Agent, or Firm*—William G. Valance

[57] ABSTRACT

The anchoring member for securing an outdoor container, especially an outdoor mailbox, to the ground comprises a shank made of an angle iron with a knife edge on the bottom end for easier penetration of the ground, a pivotable substantially flat connector plate pivotally attachable to the shank in the vicinity of its upper end and to the outdoor container and two pivotable securing arms, each of which is pivotally attached to the shank in the vicinity of the lower end of the shank pivotable between a folded in position against the shank and a deployed position extended outward to restrain withdrawal of the shank from the ground. Each securing arm is made from a flat metal piece which is twisted to form a knife portion having a knife edge on a bottom end thereof which also acts as a stop and an earth-bearing portion whose upper surface is substantially perpendicular to the knife portion forming a bearing surface for the ground restraining withdrawal. A method of securing an outdoor container is also described.

2 Claims, 2 Drawing Sheets

Fig. 3
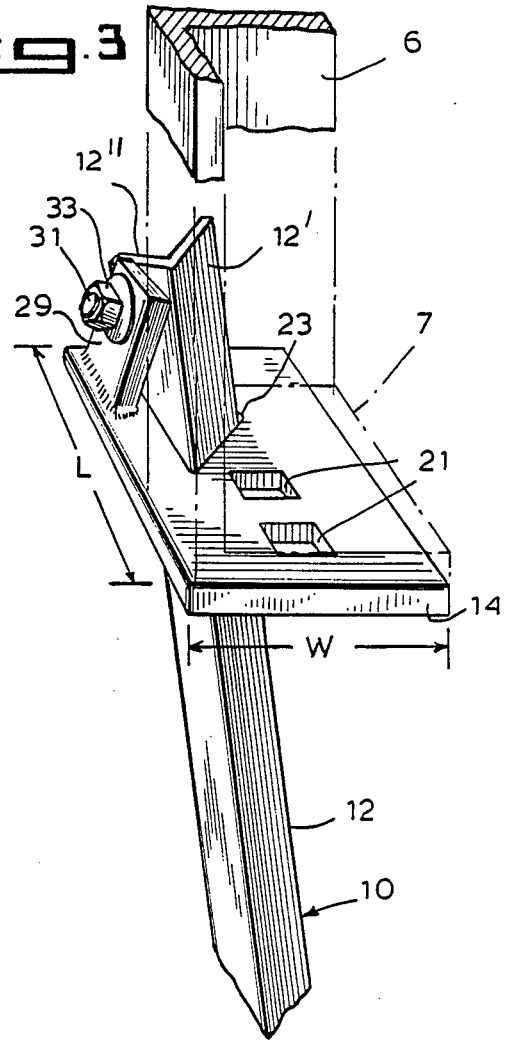
Fig. 4
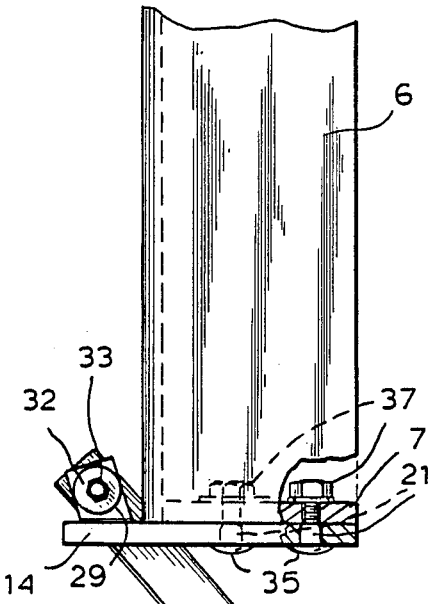
Fig. 5
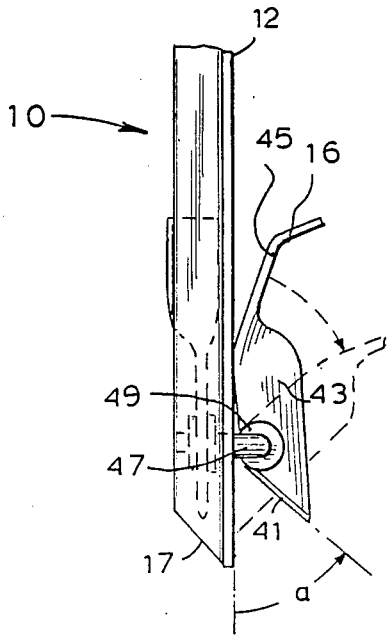
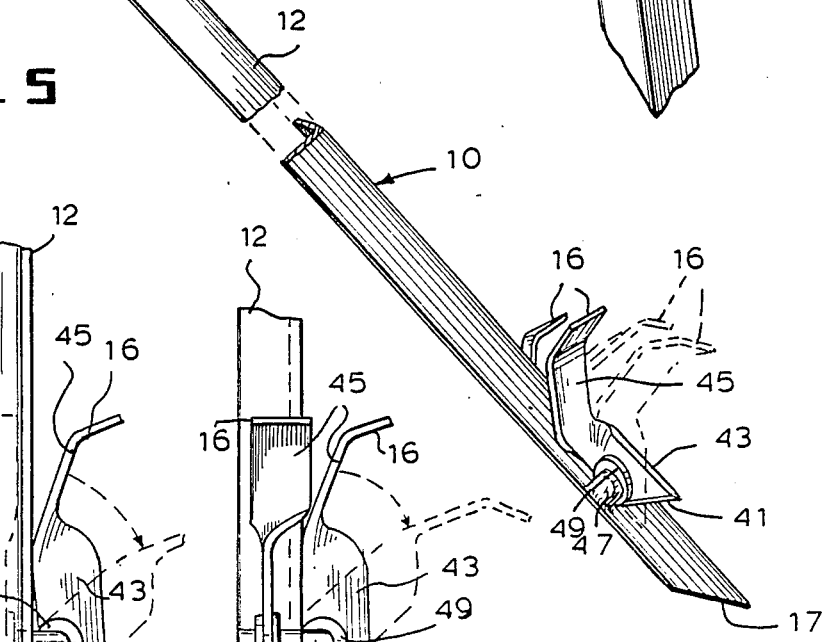
Fig. 6

ANCHORING MEMBER FOR AN OUTDOOR CONTAINER ESPECIALLY AN OUTDOOR MAILBOX

FIELD OF THE INVENTION

My invention relates to an anchoring member for a container located out-of-doors and, more particularly, to an anchoring member for an outdoor mailbox used to receive mail and to store it until it is picked up by a carrier for transport to the post office or a central distribution point. It also relates to a method for safely anchoring an outdoor container to the ground.

BACKGROUND OF THE INVENTION

In many localities, particularly urban localities, the public deposits mail in a large metal container called a mailbox which is left unattended outdoors on land adjacent streets and byways. A mail carrier who has a key to this mailbox opens it, picks up letters which have been deposited in the mailbox and transports them to a central location. This container usually has a large pivotally mounted door through which mail is put in the mailbox, a rounded top portion and legs which are secured to the ground on substantially flat feet.

Currently the typical outdoor mailbox has four legs each having a foot at its bottom end which is substantially flat. The mailbox is held in place by metal, usually iron or steel, angle pieces which, after being driven in the appropriate place in the ground, are bolted to the feet of the mailbox. These stakes which may be about 2 feet long and about 1 inch by 1 inch are driven in the ground prior to securing the mailbox. They may be $\frac{1}{8}$ inch thick and have a sharp point for insertion in the ground.

There are disadvantages to this method of securing a mailbox to the ground. Simply driving four metal stakes in the ground does not provide a secure attachment of the mailbox. An individual or group of individuals who want to vandalize the mailbox or steal its contents can exert an upward force on the mailbox which varies according to the climatic conditions and the type of ground and pull the angle pieces securing the mailbox from the ground. When the mailbox is removed in this way sometimes the individuals removing it are injured by the pointed angle pieces which may be propelled in various directions when the mailbox is pulled from its location. That might also occur if the mailbox is struck by a motor vehicle involved in an accident on the road adjacent the mailbox.

It is an object of my invention to provide an improved anchoring member for a container located out-of-doors, especially for an outdoor mailbox, which provides a more secure attachment of the container to the ground than current attachment means.

It is also an object of my invention to provide an improved anchoring member for a container located out-of-doors, especially for an outdoor mailbox, which provides a safer attachment of the mailbox to the ground than currently so that individuals attempting to remove the mailbox are not inadvertently injured by the attachment means.

It is another object of my invention to provide an improved anchoring member for an outdoor mailbox which secures the outdoor mailbox to the ground which can not be drawn from the ground or can be drawn from the ground only by applying an upward force on either the mailbox or itself which is much greater than is required to withdraw the current anchoring member.

It is an additional object of my invention to provide an improved method of anchoring an outdoor mailbox which provides a more secure attachment of the container to the ground than the current method.

SUMMARY OF THE INVENTION

According to my invention an anchoring member for securing an outdoor container, especially an outdoor mailbox, to the ground comprises a shank, a pivotable substantially flat connector plate attachable to the shank in the vicinity of the upper end of the shank and at least one securing arm pivotally attached to the shank in the vicinity of the lower end of the shank pivotable between a folded in position against the shank and a deployed position extended outward to restrain the shank from being withdrawn from the ground.

In one advantageous embodiment of my invention two securing arms are mounted on the shank and each securing arm is made from a flat metal piece which is twisted to form a knife portion having a knife edge on a bottom end thereof and an earth-bearing portion whose upper surface is substantially perpendicular to the knife portion. This knife portion is pivotally mounted on a pivot rigidly attached to the shank with two bearing washers attached to the pivot and bearing on opposite sides of the knife portion. The knife edge on the bottom of the knife portion can be oriented at an acute angle to the longitudinal direction of the knife portion to form a stop for the pivotable securing arm in the deployed position.

The shank may be made of an angle iron piece comprising two connected plate portions which are oriented approximately at a right angle to each other. Knife edges may be provided on the bottom end of the shank for easier penetration of the ground.

The connector plate may be substantailly rectangular and may have a length substantially longer than the length of the foot of the mailbox and a width substantially equal to that of the foot. A substantially rectangular shank mount is attached to the top side of the connector plate adjacent an angular slot through which the shank is passed. The shank can be attached to the shank mount by a shank bolt in the vicinity of the top end of the shank. The connector plate is provided with square holes so that square-headed bolts may be used to attached the connector plate to a foot of the mailbox.

The shank with the pivotable securing arms is driven into the ground where the mailbox is to be secured. When it is pulled back the pivotable securing arms at the lower end are deployed extending outward so that their upper surfaces press on the earth providing a much greater resistance to withdrawal than the current anchoring means. Washers attached to the pivot of the securing arms provide additional bearing surface which helps prevent bending of the securing arm under twist and shear forces. The connector plate is attached to the shank in the vicinity of its upper end. A foot of the mailbox is secured to the connector plate of the anchoring member. Thus the anchoring member provides a safe means of attaching the mailbox to the ground which is considerably stronger than the current anchoring means.

DETAILED DESCRIPTION OF THE DRAWING

FIG. 3 is a perspective view of the top portion of the anchoring member of FIG. 1 with the leg and foot of the mailbox indicated with dot-dashed lines.

FIG. 4 is a side elevational view of the anchoring member of FIG. 1 attached to a foot and leg of the mailbox.

FIGS. 5 and 6 are side elevational action views of the bottom portion of the anchoring member of FIG. 1 showing the pivotable securing arm deployment.

THE SPECIFIC DESCRIPTION

Figure 1:
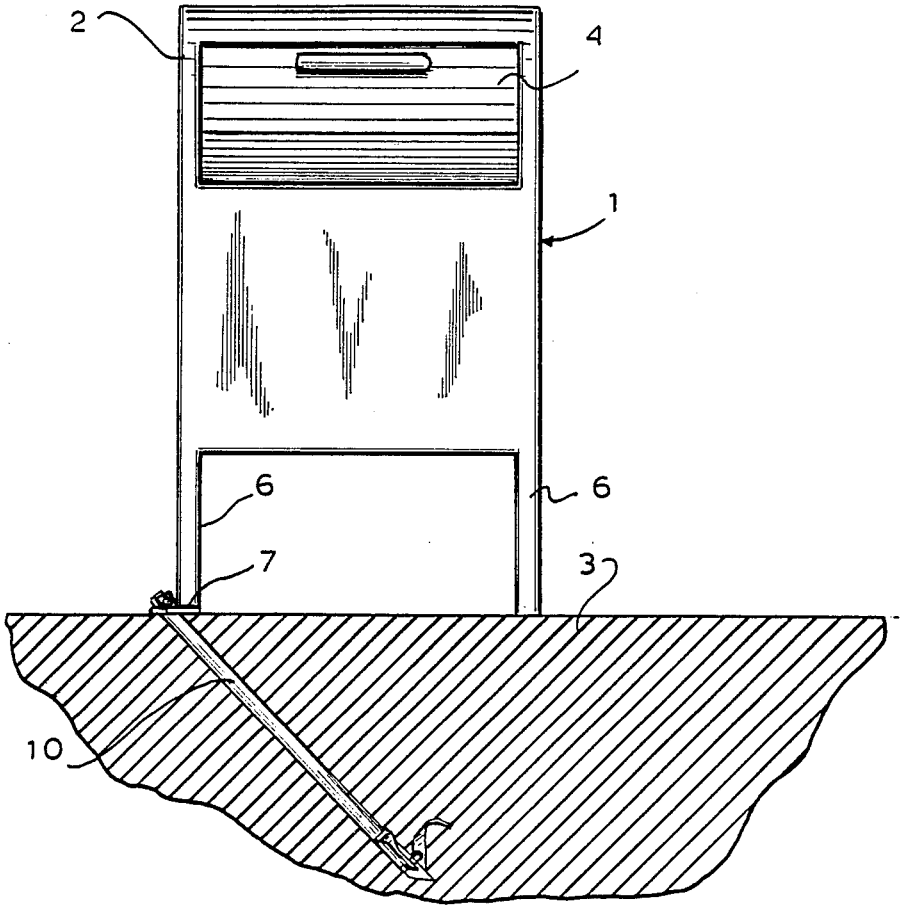
FIG. 1 is a front elevational view of a mailbox anchored to the ground with an anchoring member according to my invention.

FIG. 1 shows one example of an outdoor mailbox 1 anchored to the ground 3 with an anchoring member 10 according to my invention. This mailbox 1 has a rounded top portion 2 and a pivotable door 4 which is weighted so that it is normally closed but can be swung open to put mail in the mailbox 1. The mailbox 1 has four substantially vertical legs 6 each having a substantially horizontal foot 7 at its free end oriented approximately perpendicular to the longitudinal direction of the leg 6 to which it is attached.

The anchor member 10 of the embodiment shown here comprises a shank 12, a pivotable substantially flat connector plate 14 attached to the shank 12 in the vicinity of its upper end and two pivotable securing arms 16 pivotally attached to the shank 12 in the vicinity of its lower end. By "upper end" of the shank 12 we mean of course that end of the shank 12 which is attached to the mailbox 1. By "lower end" we mean the end opposite the "upper end", which is driven in the ground.

The shank 12 is an angle iron piece advantageously about 2 feet long with two connected plate portions 12',12" which are oriented at about a right angle to each other. The end of the shank 12 which is driven in the ground 3 has knife edges 17 inclined to the longitudinal direction of the shank 12 on both plate portions 12' and 12". Both of these knife edges 17 meet at a point at the end of the shank and make it easier to drive the shank 12 into the ground 3.

Figure 2:
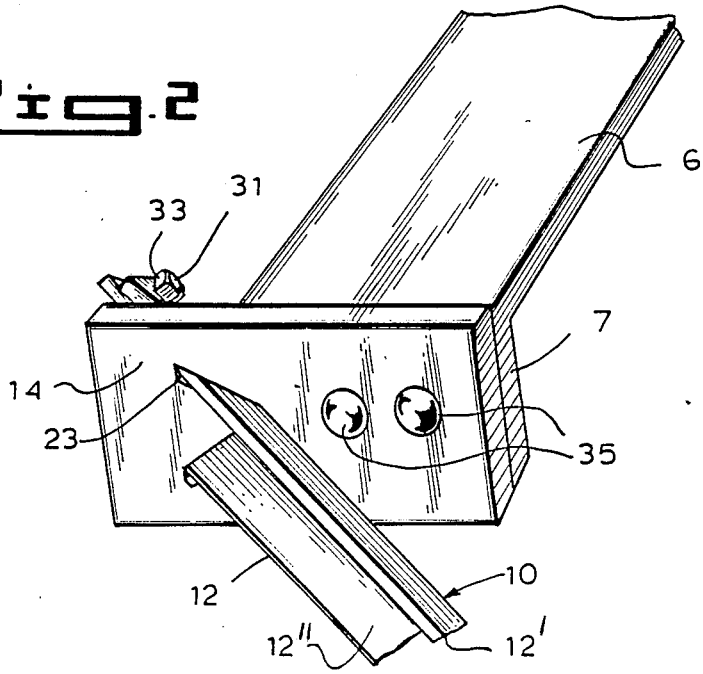
FIG. 2 is a perspective view of a foot of the mailbox with the anchoring member of FIG. 1 attached showing the method of attachment.

The substantially flat connector plate 14 is best shown in FIGS. 2, 3 and 4. It is designed to fit the nearly flat foot 7 of a leg 6 of the mailbox 1. The connector plate 14 is substantially rectangular and has a length L which is longer than the length of the substantially rectangular foot 7 but a width W which is substantially the same as the width of the foot 7. The connector plate 14 is provided with two square holes 21 which are used to secure the connector plate 14 to the bottom of the foot 7. The connector plate 14 is also provided with an angular slot 23 comprising two connected linear portions through which the shank 12 can be passed. The angle between the linear portions of this angular slot 23 is determined by the angle between the plate portions 12' and 12" of the connector plate 14. The linear portions of this angular slot 23 may be drilled at an angle to plane surface of the connector plate 14. Then, when the shank 12 is passed through the connector plate 14, it is oriented at an acute angle to the plate of the connector plate 14 and also to the ground 3. The upper end of the shank 12 is provided with a shank hole. A shank mount 29 which is a substantially rectangular metal piece is attached, preferably by welding, to the top surface of the connector plate 14 adjacent a corner of the connector plate 14 and may be somewhat inclined to the vertical. A shank mount hole is provided in the upper portion of this shank mount 29. The shank 12 is attached to the connector plate 14 after it has been passed through the angular slot 23 by passing a shank bolt 31 through the shank hole and the shank mount hole after the shank 12 has been positioned to make these two holes coincide and by securing the bolt with a shank bolt washer and nut 32 and 33. Then the foot 7 of the mailbox 1 can be positioned so that the square holes 21 in the connector plate 14 coincide with the holes in the foot 7 and square-headed bolts 35 can be inserted in the square bolt holes 21 so that the connector plate 14 can be tightened by engaging connector bolt nuts 37 on the square-headed bolts 35.

In the embodiment shown in the drawing there are two pivotable securing arms 16 mounted on the shank 12. Each securing arm 16 is mounted on one of the plate portions 12' or 12" in the vicinity of the lower end of the shank 12. The individual securing arm 16 is made from a flat metal piece which is twisted so that it has essentially two portions: a knife portion 43 having a knife edge 41 on its bottom end and an earth-bearing portion 45 whose upper surface is substantially perpendicular to the knife portion 43. The knife portion 43 is provided with a pivot hole through which a pivot 47 passes. This pivot 47 is rigidly attached to the shank 12 and is formed so that the knife portion 43 can pivot from a folded in position shown with solid lines in FIG. 6 in which it contacts the shank 12 and in which the longitudinal direction of the knife portion 43 is oriented substantially parallel to the longitudinal direction of the shank 12 and a deployed position in which it is extended outward from the shank 12 shown in dotted in FIG. 6 in which the knife edge 41 acts as a stop limiting the pivot motion of the securing arm 16. Washers 49 are welded on the pivot 47 on each side of the securing arm 16 to provide additional bearing surface for the securing arm 16 so that when the anchoring member is twisted or pulled while in the ground 3 it is more difficult to twist or bend the securing arm 16 on the pivot 47.

In operation the anchoring member 10 according to my invention may be used as follows:

First a comparatively level site for the mailbox 1 is chosen having suitable ground 3 in the vicinity of the desired location, usually adjacent a street corner or a street in an urban locality. Then at least one of the four corners of the mailbox 1 where the foot 7 of the mailbox would rest the shank 12 of the anchoring member 10 without the connecting plate 14 is driven in the ground 3 with the securing arms 16 folded against the shank 12. The knife edges 41 and 17 help the shank 12 penetrate the ground 3. The shank 12 is driven into the ground 3 until it is almost completely under the ground 3. Then it is pulled back deploying the pivotable securing arms 16 so that they extend outward and the knife edge 41 comes to rest on the shank 12. Then the ground presses on the top surface of the earth-bearing portion 45 restraining any further withdrawal of the shank 12 from the ground 3 while the knife edges 41 prevent any further rotation of the pivotable securing arms 16. Then the connecting plate 14 is slipped on the protruding upper end of the shank 12 passing it through the angular slot 23 and the shank 12 is secured to the connector plate 14 by the shank bolt 31. Also the square-headed bolts 35 are passed through the bottom of the connector plate 14 and the foot 7 of the mailbox 1 and secured. Then the anchoring member 10 holds the mailbox 1 in place. A significantly larger force is necessary to pull the anchoring member 10 and the mailbox 1 from the ground 3 than is required with the conventional attaching means. A particularly secure attachment is attained when four anchoring members 10 are used to secure all four corners of the mailbox 1 to the ground 3.

LIST OF REFERENCE NUMBER

1 mailbox
2 top portion(of the mailbox)
3 ground
4 pivotable door
6 leg
7 foot
10 anchoring member(the invention)
12 shank
14 connector plate
16 pivotable securing arm
17 knife edge
21 square hole
23 angular slot
29 shank mount
31 shank bolt
33 shank bolt nut
35 square-headed bolt
37 square-headed bolt nut
41 knife edge
43 knife portion
45 earth-bearing portion
47 pivot
49 bearing washer
a maximum angle between knife edge 41 and shank 12
L length of the connector plate 14
W width of the connector plate 14

The invention is not intended to be limited to the details provided above in the specific description and it will be understood that various omissions, modifications, substitutions and changes in the forms and details of the device illustrated and in its operation can be made by those skilled in the art without departing from the spirit of the invention in any way.

What is claimed is new and what is desired to be protected by Letters Patent is set forth in the following claims:

1. An anchoring member for securing an outdoor container, especially an outdoor mailbox, to the ground comprising:

a shank made of an angle iron piece having two connected plate portions which are oriented at about a right angle to each other, a knife edge being provided on the bottom end of each of said plate portions inclined to the longitudinal direction of said shank which comes to a point for an easier penetration of said ground;

a pivotable substantially flat connector plate attachable to said shank in the vicinity of the upper end of said shank and to said container; and two pivotable securing arms, each of which is pivotally attached to said shank in the vicinity of the lower end of said shank pivotable between a folded in position against said shank and a deployed position extended outward to restrain said shank from being drawn from said ground and is made from a substantially flat metal piece which is twisted to form a knife portion having a knife edge on a bottom end thereof and an earth-bearing portion whose upper surface is substantially perpendicular to said knife portion which is pivotally mounted on a pivot rigidly attached to said shank with two bearing washers attached to said pivot bearing on opposite sides of said knife portion, said knife edge of said knife portion being oriented at an acute angle to the longitudinal direction of said knife portion to form a stop for said pivotable securing arm in said deployed position.

2. An anchoring member according to claim 1, in which said connector plate is substantially rectangular and has an angular slot having two connected linear slot portions through which said shank is to be passed, the angle between said linear slot portions of said angular slot being determined by the relative orientation of said plate portions, a substantially rectangular shank mount being attached to the top side of said connector plate adjacent said angular slot to which said shank is attachable by a shank bolt in the vicinity of said upper end of said shank so that said shank is orientable at an acute angle to said connector plate.

* * * * *